US008333338B2

(12) United States Patent
Pallmann

(10) Patent No.: US 8,333,338 B2
(45) Date of Patent: Dec. 18, 2012

(54) COMMINUTING TOOL AND COMMINUTING DEVICE WITH SUCH A COMMINUTING TOOL, AS WELL AS A METHOD FOR DETERMINING THE STATE OF WEAR OF SUCH A COMMINUTING TOOL

(75) Inventor: Hartmut Pallmann, Zweibrücken (DE)

(73) Assignee: Pallman Maschinenfabrik GmbH & Co. KG, Zweibruecken (DE)

( * ) Notice: Subject to any disclaimer, the term of this patent is extended or adjusted under 35 U.S.C. 154(b) by 269 days.

(21) Appl. No.: 12/705,205

(22) Filed: Feb. 12, 2010

(65) Prior Publication Data

US 2010/0206967 A1 Aug. 19, 2010

(30) Foreign Application Priority Data

Feb. 12, 2009 (DE) ..... 10 2009 008 642

(51) Int. Cl.
*B02C 2/00* (2006.01)
*B02C 19/00* (2006.01)
*B02C 7/04* (2006.01)

(52) U.S. Cl. ..... 241/101.3; 241/261.3; 241/301

(58) Field of Classification Search ..... 241/301, 241/101.3, 37, 261.2, 261.3
See application file for complete search history.

(56) References Cited

U.S. PATENT DOCUMENTS

| | | | | | |
|---|---|---|---|---|---|
| 3,314,618 | A | * | 4/1967 | McDonald | 241/299 |
| 3,497,146 | A | * | 2/1970 | May | 241/293 |
| 3,619,439 | A | * | 11/1971 | Rea | 156/89.24 |
| 4,886,218 | A | * | 12/1989 | Bradley et al. | 241/294 |
| 5,184,389 | A | * | 2/1993 | Dean | 29/467 |
| 6,129,297 | A | * | 10/2000 | Sawant et al. | 241/101.3 |
| 7,172,144 | B1 | * | 2/2007 | Slater et al. | 241/101.2 |

FOREIGN PATENT DOCUMENTS

| | | |
|---|---|---|
| DE | 23 60 003 | 6/1975 |
| DE | 10 2006 056 542 A1 | 6/2008 |
| EP | 0 019 542 A1 | 11/1980 |

* cited by examiner

*Primary Examiner* — Faye Francis
(74) *Attorney, Agent, or Firm* — Muncy, Geissler, Olds & Lowe, PLLC

(57) ABSTRACT

A device for the determination of the state of wear of comminuting tools a comminuting tool, a comminuting device with such a comminuting tool, and a corresponding method. A reference surface is provided on the comminuting tool, the surface from which the distance $A_0$, $A_1$ to the active edges of the comminuting tool can be determined. The degree of wear then results from a comparison of the original distance $A_0$ in an unused comminuting tool with the distance $A_1$ reduced due to wear after a certain period of use. The thereby achieved advantage is that the state of wear can be determined independent of the general wear of the comminuting device. A distortion of the measurement result caused by this is therefore ruled out.

6 Claims, 7 Drawing Sheets

Ia
Ia
IIa
IIa
1
2
3
4
4'
5
9
27
33
34
$A_0$
$A_1$

COMMINUTING TOOL AND COMMINUTING DEVICE WITH SUCH A COMMINUTING TOOL, AS WELL AS A METHOD FOR DETERMINING THE STATE OF WEAR OF SUCH A COMMINUTING TOOL

This nonprovisional application claims priority under 35 U.S.C. §119(a) to German Patent Application No. DE 10 2009 008 642, which was filed in Germany on Feb. 12, 2009, and which is herein incorporated by reference.

BACKGROUND OF THE INVENTION

1. Field of the Invention

The present invention relates to a comminuting tool for a comminuting device having a rotor-stator system or rotor-rotor system and to a method for determining the state of wear of a comminuting tool.

2. Description of the Background Art

The conversion of materials into an intermediate or end product, for example, and therefore also the comminution of materials fall within the field of mechanical process engineering. The category of comminuting machines suitable for this purpose also includes devices with a rotor-stator system or rotor-rotor system. Their rotors are edged with comminuting tools, which over the course of rotation are moved past the tools of a stator or second rotor and comminute the feedstock during interaction with these. Shearing tools, blades, hammers, and the like, for example, are known as comminuting tools.

During the operation of such devices, the comminuting tools are exposed to great mechanical stress, which depending on the type of feedstock results in more or less great wear. With increasing wear, the geometry of the comminuting tools and thereby the effectiveness of the comminution also change. Because of the associated deviations from the optimal starting conditions, the quality of the end product suffers, which deviates in its shape, size, and surface quality from target specifications or is subjected to variations outside the tolerance range. In addition, the energy consumption and heat production within the device also increase with increasing wear of the comminuting tools.

To avoid these disadvantages, it is therefore necessary to check the degree of wear of the comminuting tools at predefined time intervals. The precise determination of the current state of wear of comminuting tools is therefore very important.

In practice, this occurs rather often only by a visual examination without the use of other auxiliary means. The accuracy of the information obtained thereby as expected leaves much to be desired. It is typical in addition to determine the distance of the rotor tool to the stator, thus, the width of the working gap, with use of a pocket rule. This distance increases with increasing wear, and is therefore an indicator of the state of wear of the comminuting tools. This type of wear determination entails the risk, however, that with wear of the stator the reference surface there changes, which results in an incorrect measurement result.

SUMMARY OF THE INVENTION

It is therefore an object of the present invention to provide the possibility of being able to determine reliably, simply, and precisely the wear on comminuting tools on a long-term basis.

The invention is based on the situation that during continued operation of devices equipped with generic comminuting tools the distance between the active edges of the comminution area and the bearing area decreases increasingly due to wear, the comminuting tool therefore becoming shorter in this direction. Only wear in this direction, which defines the main wear direction, affects the gap width to the stator or neighboring rotor and subsequently detrimentally impacts the quality of the comminution.

The active edges are thereby formed by the points of the comminution area that define the smallest gap width to the stator, in other words, therefore have the greatest distance to the bearing area.

Proceeding from these considerations, the principle of the invention is to provide the reference surface for a gauge on the tool itself, so that the wear on the rotor and/or stator has no effect on the measurement result. Instead, the degree of wear results from the distance of the active edge perpendicular to the reference surface. This distance defines the distance direction which according to the invention is parallel to the main wear direction. In a simple advantageous embodiment of the invention, it is provided for this purpose that at least one perimeter side of the comminuting device is formed planar above the reference surface and the reference surface is arranged on this side. As a result, the gauge can be brought simply and precisely into the measuring position by full-surface resting against the planar side and tapping against the reference surface.

In an embodiment of the invention, a reference surface running along the perimeter of the comminuting tool is provided, or reference surfaces also on opposite sides of the comminuting tool, which extend preferably over the entire side length. Above all, in comminuting tools with long active edges, extending over the entire working width of the device, the advantage arises that the state of wear can be determined over the entire course of the active edge.

According to an embodiment of the invention, the reference surface is formed by a projection or lip extending beyond the external perimeter of the comminuting tool, which can be achieved by a slimmer shape of the comminution area compared with the bearing area. This embodiment has the advantage that the reference surface is readily accessible, which makes the measuring process easier.

In addition, embodiments fall within the scope of the invention in which for the formation of reference surfaces a recess or a groove is provided on the outer perimeter of the comminuting tool. Above all, in combination with feedstock causing severe wear, such embodiments have the advantage that the reference area is protected lastingly and therefore remains unchanged for the entire lifetime of a comminuting tool.

In an embodiment of the comminuting tools, the reference surface is located on the side of the comminuting tool that during operation of a comminuting device lies within the dead zone, in other words, the comminuting tool side to the rear in the direction of rotation, and is therefore naturally subjected to lower wear.

The same goal is pursued by an embodiment of the invention in which the reference surface lies flush or even slightly deeper compared with the surface of the rotor or the tool retainer in the rotor. Therefore, here as well, the reference surface is protected from more than proportionally severe mechanical stress over the course of feedstock comminution.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

FIGS. 1*a* to 2*b* show a comminuting tool 1 in the form of a shearing tool. Comminuting tool 1 is used for the coarse comminution of feedstock of all types, for example, of scrap wood, used tires, electronic waste, cable waste, and the like. A device in which comminuting tools 1 of this type can be used is described, for example, in the Unexamined German Pat. Appl. No. DE 10 2006 056 542. Stator tools are also disclosed therein, which lie opposite to the comminuting tools of the invention with maintenance of a radial working gap. The comminution between the stator tools and comminuting tools 1 occurs primarily as shearing, tearing, and crushing. The high forces attendant thereto cause high wear.

Figures 1A, 1B, 2A, 2B:
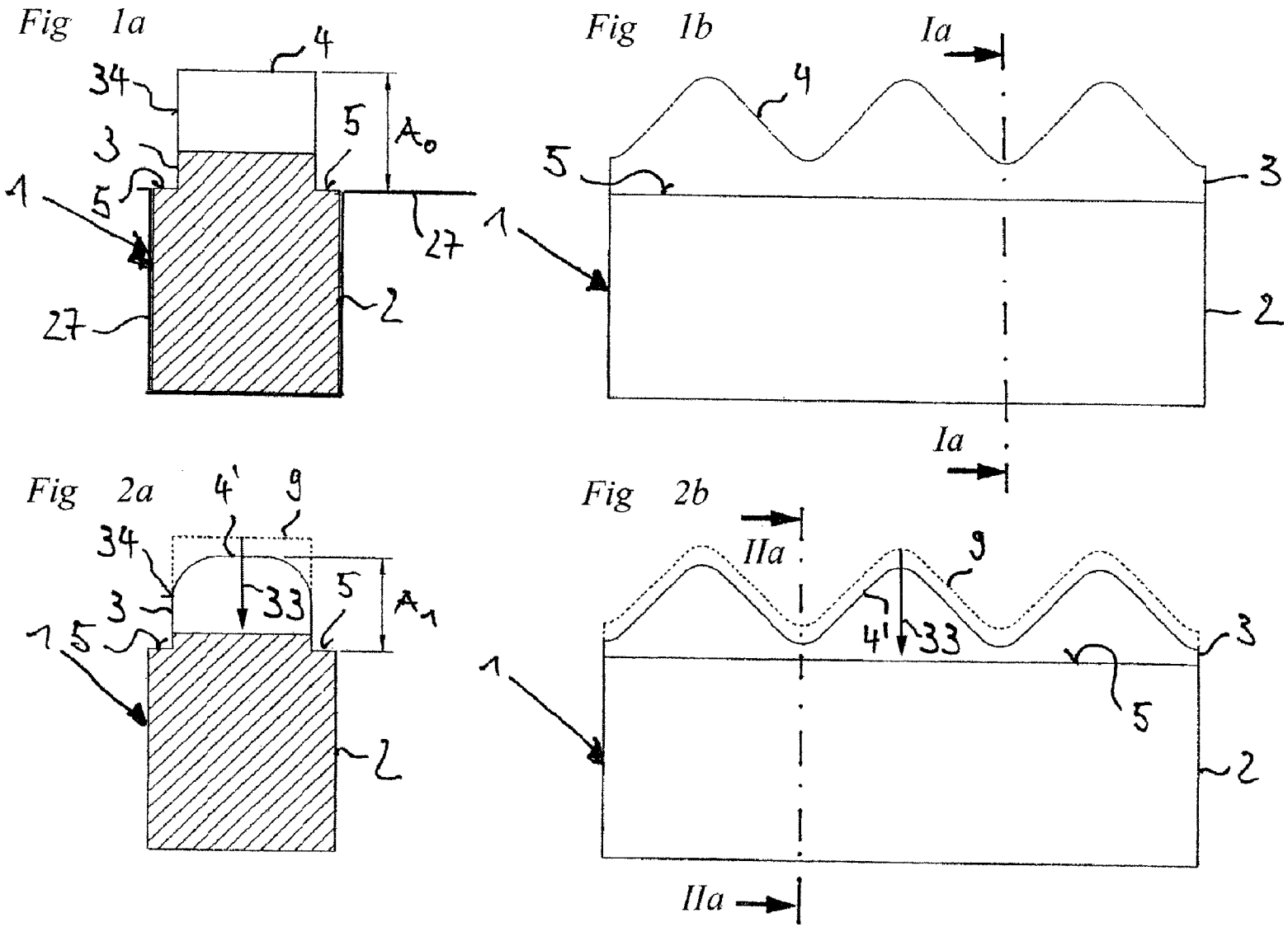
FIGS. 1*a* and *b* show a section and a side view of an unused comminuting tool in the form of a shearing blade.
FIGS. 2*a* and *b* show a cross section and a side view of the tool, shown in FIGS. 1*a* and *b*, with wear.

Comminuting tool 1 shown in FIGS. 1*a* and *b* has a rectangular base member 2, which embodies the bearing area for clamping in a complementarily shaped retainer, designated with the reference number 27, in the rotor. The comminution area, active during comminution, in the form of a cutter bar 3 with an active edge 4 with an undulating course attaches monolithically to the top side of base member 2.

As is evident primarily from the section, cutter bar 3 has two plane-parallel sides 34, which are offset inwardly relative to base member 2. As a result, base member 2 forms projections, running bilaterally along the entire longitudinal extension, at the outer perimeter of comminuting tool 1, which in each case produce reference surfaces 5 and run plane-parallel to the plane defined by the end of comminuting tools 1. The perpendicular distance $A_0$ of active edges 4 to reference surfaces 5 defines the target dimension in unused comminuting tools 1.

FIGS. 2*a* and *b* show the same comminuting tool 1 after its use in a comminuting device and therefore show the state of wear. To make the original state clearer, it is depicted with the dotted line 9. It is evident that the height of cutter bar 3 has become shorter and thereby the position of active edge 4' has also changed. Based on the use of comminuting tool 1 in the reverse operation of the rotor, a wear pattern symmetrical in cross section results. The degree of wear corresponds to the difference between the distance $A_0$ in the unused state and the distance $A_1$ in the state of wear. The main wear direction is shown by the arrow 33.

Figure 3A:
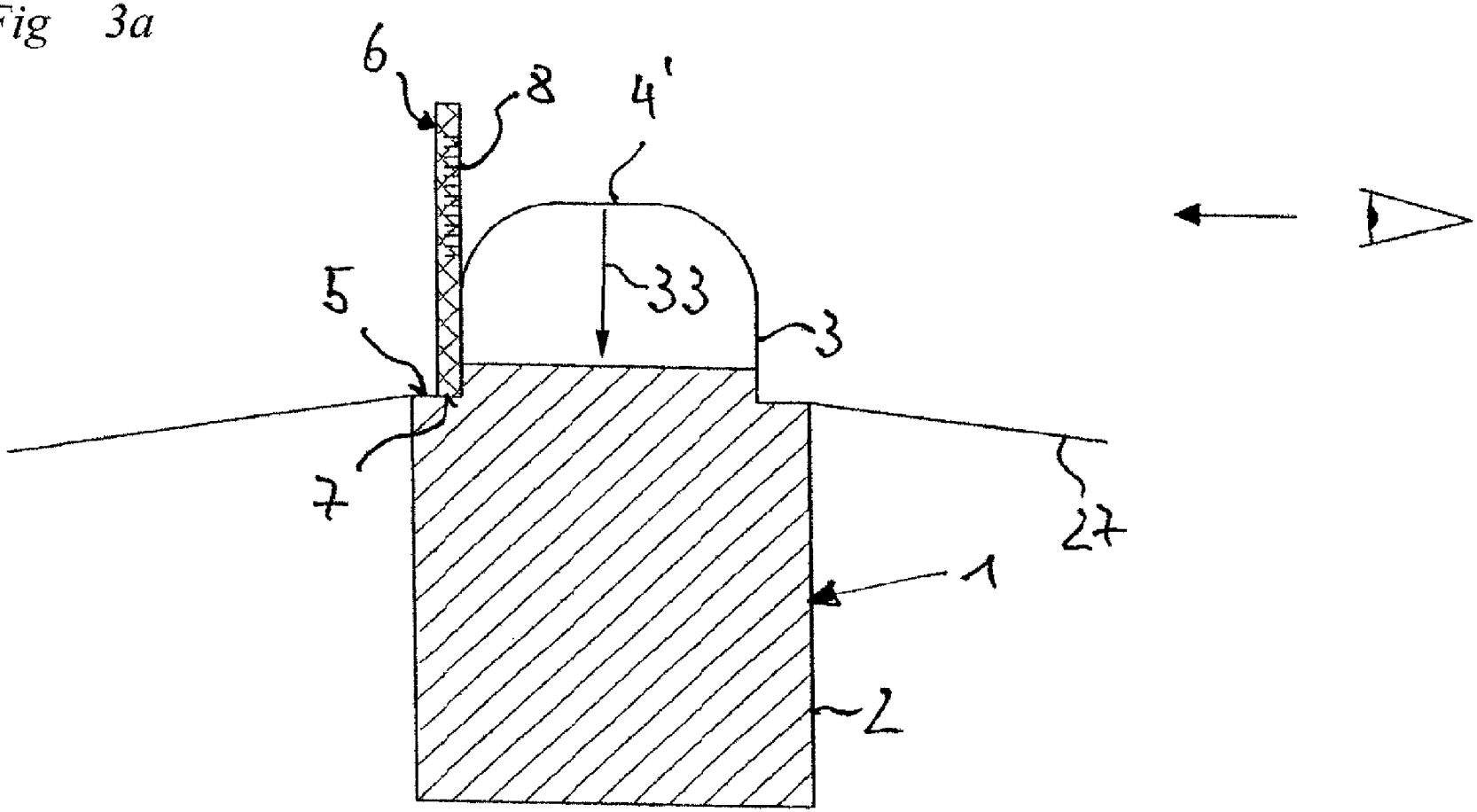
FIGS. 3*a* and *b* show the process of wear determination in the comminuting tool shown in FIGS. 2*a* and *b;*
Figure 3B:
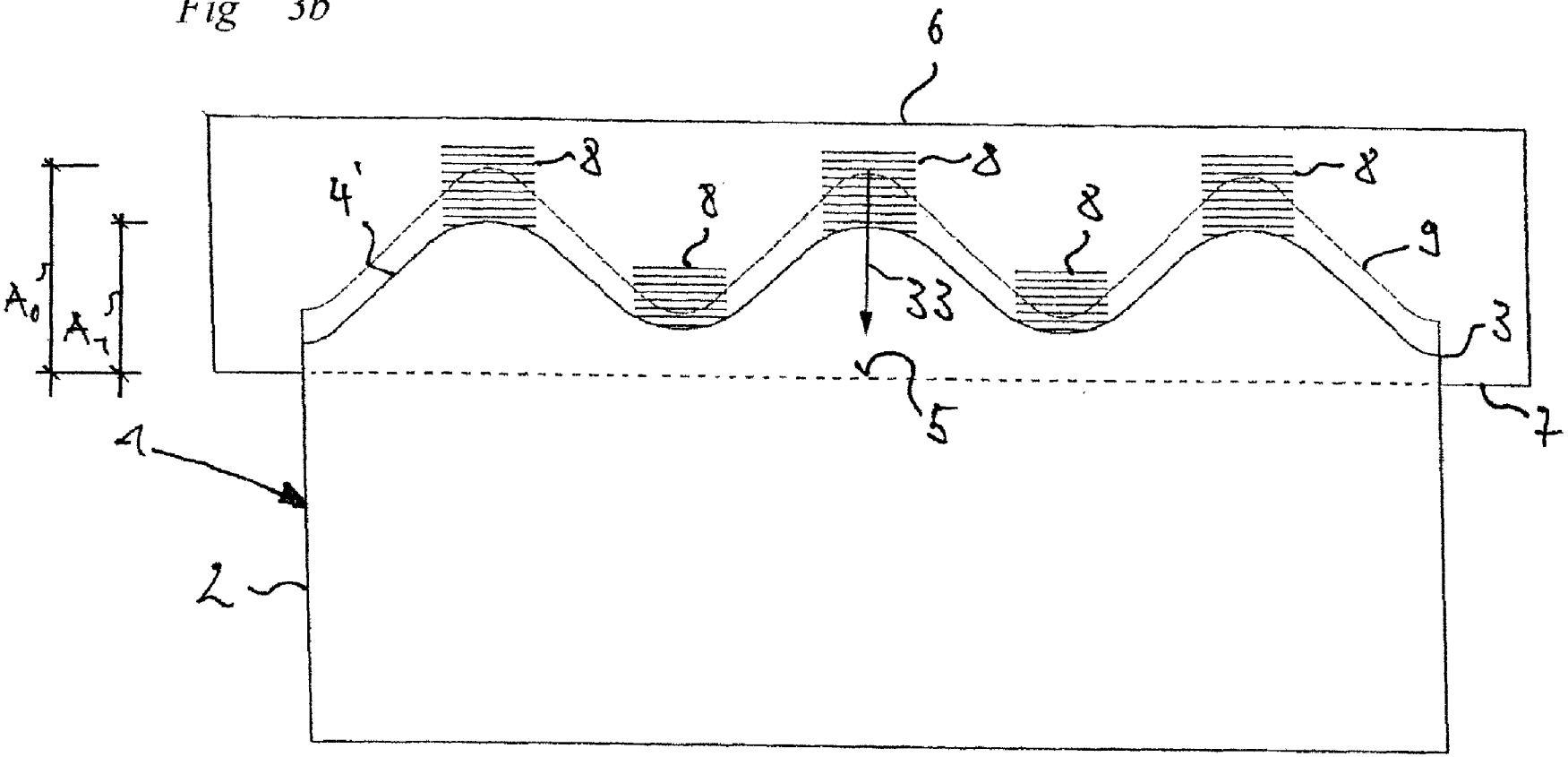

The determination of the distance $A_1$ is shown in FIGS. 3*a* and *b*. To this end, a gauge 6 of the invention, including a flat, level strip with a stop edge 7 and marks 8, is placed at side 34, which faces tool 1, against reference surface 5 and with the entire surface against the planar side. The marks show the perpendicular distance of active edge 4' to reference surface 5. The extent of the shortening and therefore the wear can be read off the mark 8 by visual reading by the maintenance personnel.

FIGS. 4*a* to 5*b* show the invention in an example of a comminuting tool 10 in the shape of a hammer. Comminuting tools 10 of this type are used, for example, for the disintegration of fiber-containing material in hammer mills. This type of use is described, for example, in European Patent Application No. EP 0 019 542 A1, which is incorporated herein by reference. The stator working together with comminuting tools 10 is formed in such devices typically by a cylindrical screen, which surrounds the rotor coaxially while maintaining a working gap.

Figure 4A:
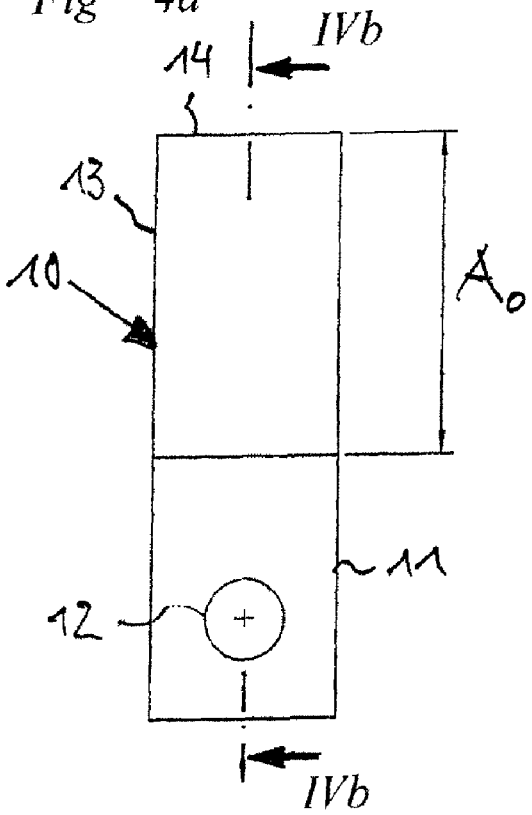
FIGS. 4*a* and *b* show a side view and a section of an unused comminuting tool in the form of a hammer.
Figure 4B:
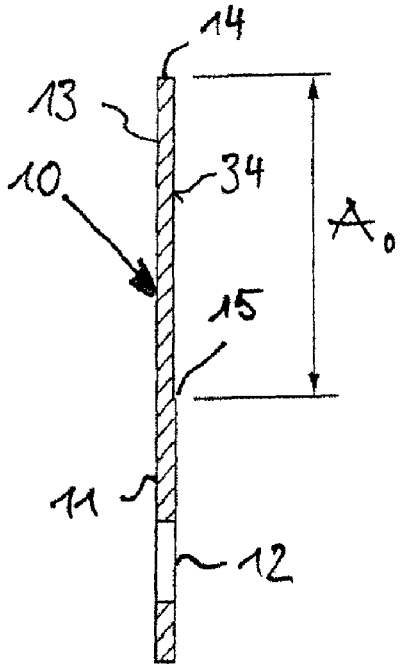

Comminuting tool 10 is shown in the unused state in FIGS. 4*a* and *b*. Comminuting tool 10 has a plate-shaped design with a bearing area 11, in which a bored hole 12 for the pendular suspension of comminuting tool 10 in a rotor is introduced. Comminution area 13, which is active during comminution and whose two opposite plane-parallel sides 34 end with an active edge 14, joins bearing area 11 outwardly. Because of the different thicknesses in the transitional area, a one-sided projection of bearing area 11 arises over comminution area 13, which results in the formation of a reference surface 15. The perpendicular distance $A_0$ of active edge 14 to reference surface 15 defines the distance direction and again represents the target dimension characteristic for an unused comminuting tool 10.

Figure 5A:
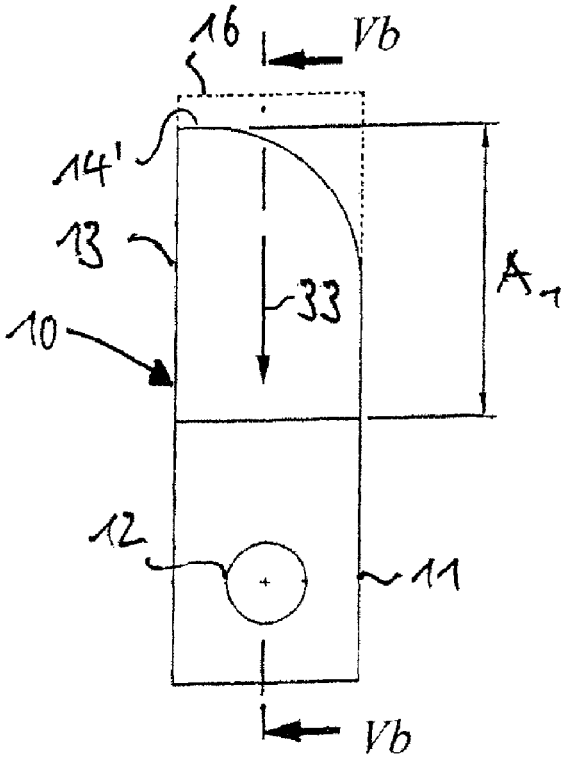
FIGS. 5*a* and *b* show a side view and a section of the tool, shown in FIGS. 4*a* and *b*, with wear.
Figure 5B:
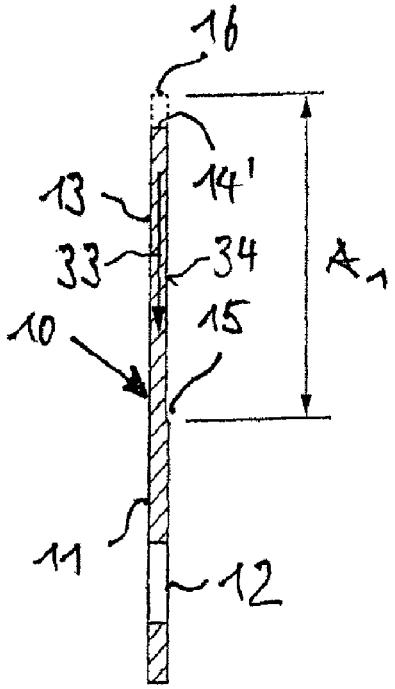

The state of comminuting tool 10 after its use in a comminuting device is again shown in FIGS. 5*a* and *b*, the dotted line 16 enabling a comparison with the original state. FIGS. 5*a* and *b* show that the height of comminution area 13 has been reduced due to wear and therefore the position of the active edge 14' is moved closer to bearing area 11. The wear that is present results in turn from the difference between the original distance $A_0$ and the distance $A_1$.

Figure 6:
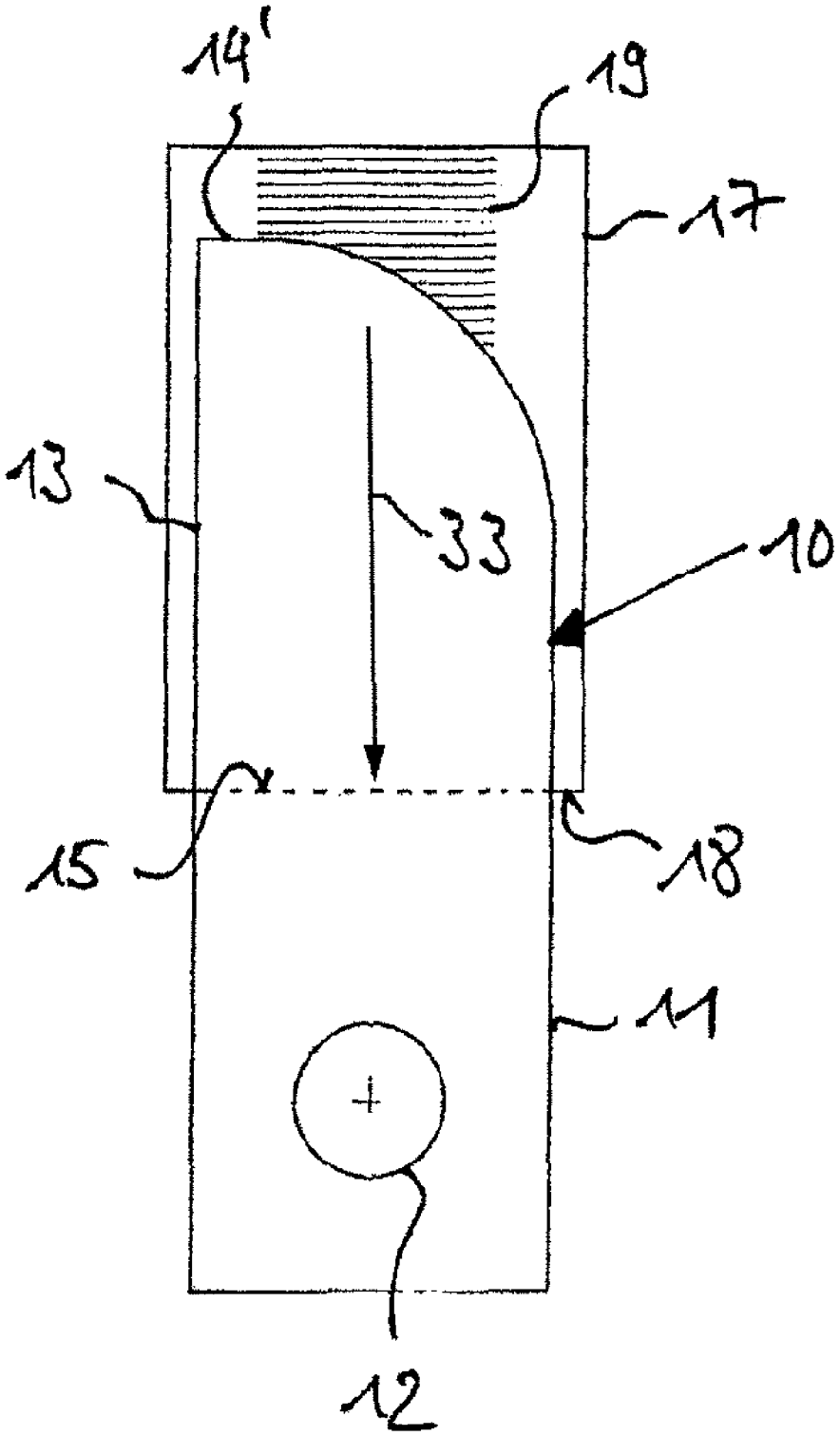
FIG. 6 shows the process of wear determination in the comminuting tool shown in FIGS. 5*a* and *b;*

FIG. 6 clarifies the process of wear determination. Here as well, a plate-shaped gauge 17 is placed with its stop edge 18 against reference surface 15 and simultaneously with the entire surface against planar side surface 34, whereby marks 19 made on the likewise planar side point toward tool 10. As in the previously described exemplary embodiment, the current perpendicular distance of active edge 14' to reference surface 15 can be determined visually and thereby the degree of wear in the main wear direction 33 is determined.

Another exemplary embodiment, which is not conclusive for the invention emerges from FIGS. 7*a* to 8*b*, which show a comminuting tool 20 in the form of a blade. This type of comminuting tool 20 is used for the chipping or chopping comminution of feedstock, for example, of wood and is used in cutter head chippers or cutter mills, as disclosed, for example, in Unexamined German Pat. Appl. No. DE 2 360 003 A1. The stator tools here are formed by counter blades.

Figure 7A:
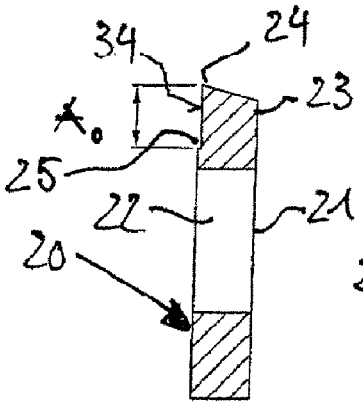
FIGS. 7*a* and *b* show a section and a side view of an unused comminuting tool in the form of a blade.
Figure 7B:
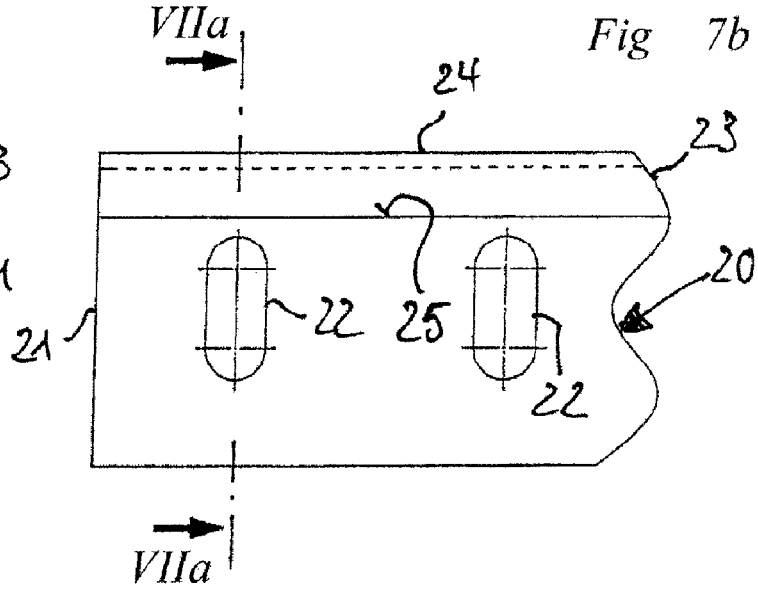

FIGS. 7*a* and *b* show the unused state of comminuting tool 20. A bearing area 21 is seen, which is designated for the rigid clamping in a cutter block. Tool 20 can be moved with use of long holes 22 in bearing area 21 and thus the position of the cutting orbit is set. Comminution area 23, which is active during comminution and ends with an undercut active edge 24, joins bearing area 21 monolithically. Different thicknesses of bearing area 21 and comminution area 23 lead to an overhang of bearing area 21 in the transitional area. As a result, in the present example, a reference surface 25 is produced at one of the two plane-parallel side surfaces 34. The target dimension for the position of active edge 24 results here as well from the perpendicular distance $A_0$ of active edge 24 to reference surface 25.

Figure 8A:
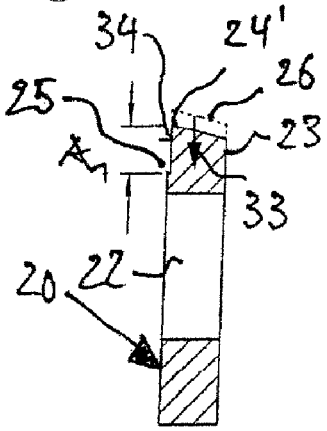
FIGS. 8*a* and *b* show a section and a side view of the tool, shown in FIGS. 7*a* and *b*, with wear.
Figure 8B:
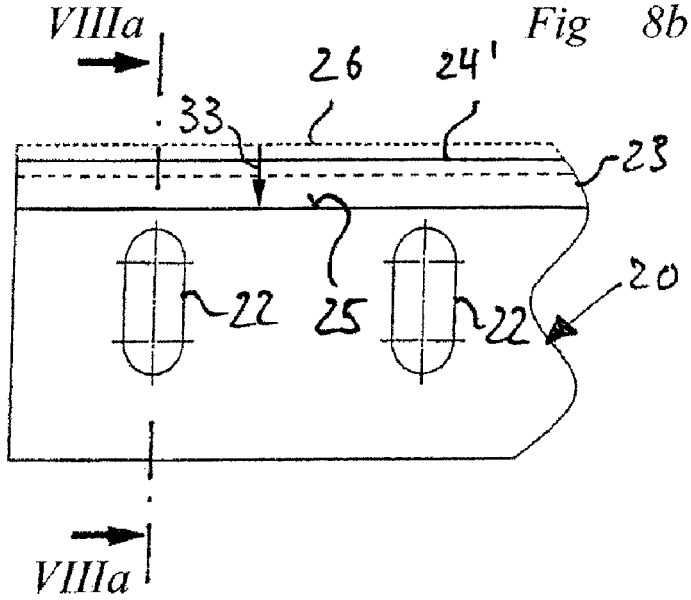

FIGS. 8*a* and *b* show the state of wear arising over the course of comminuting operation. The height of comminution area 23 declines compared with the unused original state (dotted line 26) due to the gradual wear, which results in a reduction of the distance $A_1$ between active edge 24' and reference surface 25 in main wear direction 33. The determination of the current distance $A_1$ occurs similar to the process and the embodiments of the invention described in FIGS. 1 to 6, so that the statements made there apply. The resulting wear here as well is calculated by determining the difference between the distance $A_0$ and the distance $A_1$.

Figure 9A:
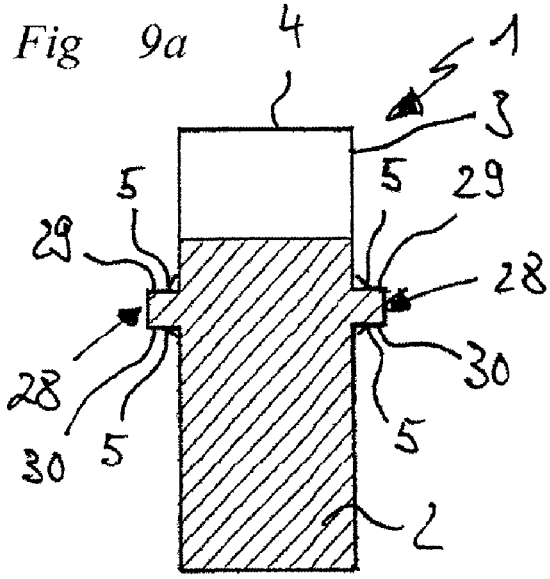
FIGS. 9*a* to *c* show cross sections of additional embodiments of comminuting tools according to the invention.
Figure 9B:
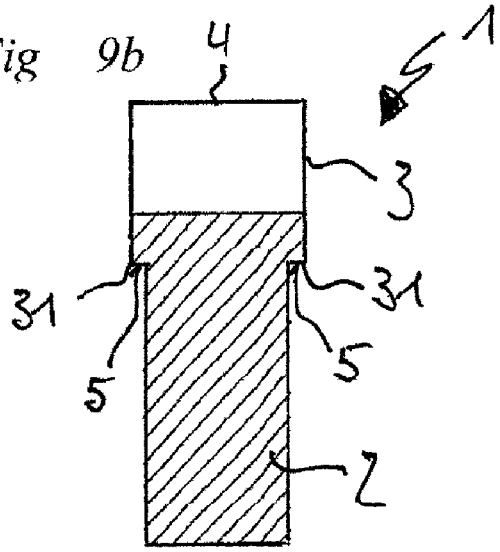
Figure 9C:
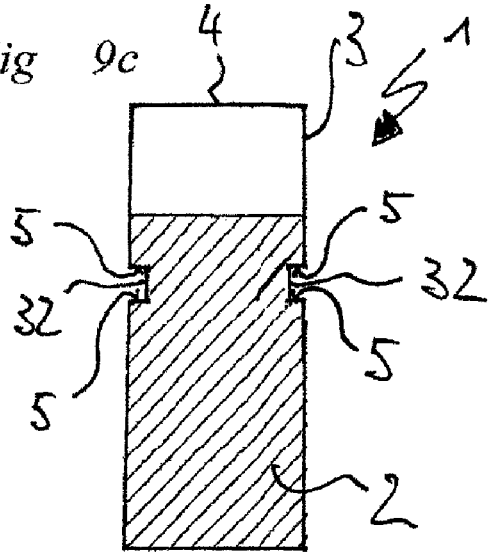

In embodiments of the invention shown in FIGS. 1*a* to 8*b*, the reference surface in each case is formed by a projection or shoulder in the side surface of the comminuting tool. The fact that the invention is not limited thereto is shown by FIGS. 9*a* to 9*c* in the example of a shearing tool 1 already described in regard to FIGS. 1 to 3. The embodiment of shearing tool 1 as shown in FIG. 9*a* has at least on one side, preferably on two opposite sides, in each case a lip 28, whereby a gauge can be tapped both against its top side 29 and its bottom side 30; reference surface 5 can therefore be formed from the top side 29 and/or the bottom side 30 of lip 28. A matching gauge can have a longitudinal groove shaped complementary to lip 28, which takes up lip 28 form-fittingly.

FIG. 9*b* shows a comminuting tool 1 in which base member 2 is designed narrower compared with comminution area 3. In this way, a recess 31 arises in the side surface of comminuting tool 1, which forms reference surface 5 of the invention. To be able to tap a gauge against reference surface 5, a suitable gauge engages behind this recess 31.

It is evident from FIG. 9*c* that reference surface 5 can also be produced by grooves 32 on the side surfaces of comminuting tools 1. Reference surfaces 5 formed by the groove flanks are accessible only with limitation from the outside and therefore protected from mechanical stress as it results from rough comminuting operation. An associated gauge can then have a complementary positive fit strip, which engages in groove 32.

It is pointed out that the present invention is not limited to the feature combinations described in the individual embodiments but combinations of features of different embodiments are also within the scope of the invention, even if they are not expressly mentioned.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A comminuting tool for a comminuting device comprising a rotor-stator system or a rotor-rotor system, a first end of the comminuting tool forming a bearing area configured to mount to the rotor and an opposite second end having a comminution area with at least one active edge, wherein at a distance from the at least one active edge at least one reference surface is arranged at an outer perimeter of the comminuting tool, wherein a distance from the at least one reference surface to the at least one active edge determines a degree of wear, and wherein the at least one reference surface runs transverse to the distance direction, wherein the outer perimeter of the comminuting tool in the area of the comminution area has at least one planar side surface along which the at least one reference surface extends.

2. The comminuting tool according to claim 1, wherein the at least one reference surface extends over an entire length of the comminuting tool.

3. The comminuting tool according to claim 1, wherein the at least one reference surface is formed by a recess or a groove on the outer perimeter of the comminuting tool.

4. The comminuting tool according to claim 1, wherein the comminuting tool is formed by a cutter bar, impact strip, blade, mallet, or hammer.

5. A comminuting tool for a comminuting device comprising a rotor-stator system or a rotor-rotor system, a first end of the comminuting tool forming a bearing area configured to mount to the rotor and an opposite second end having a comminution area with at least one active edge, wherein at a distance from the at least one active edge at least one reference surface is arranged at an outer perimeter of the comminuting tool, wherein a distance from the at least one reference surface to the at least one active edge determines a degree of wear, and wherein the at least one reference surface runs transverse to the distance direction, wherein the outer perimeter of the comminuting tool has at least two opposite sides, and wherein the at least one reference surface comprises a first reference surface on a first one of the at least two opposite sides and a second reference surface on a second one of the at least two opposite sides.

6. A comminuting tool for a comminuting device comprising a rotor-stator system or a rotor-rotor system, a first end of the comminuting tool forming a bearing area configured to mount to the rotor and an opposite second end having a comminution area with at least one active edge, wherein at a distance from the at least one active edge at least one reference surface is arranged at an outer perimeter of the comminuting tool, wherein a distance from the at least one reference surface to the at least one active edge determines a degree of wear, and wherein the at least one reference surface runs transverse to the distance direction, wherein the at least one reference surface is formed by a projection or lip extending beyond the outer perimeter of the comminuting tool.

* * * * *